US006119859A

United States Patent [19]

Wen

[11] Patent Number: 6,119,859

[45] Date of Patent: Sep. 19, 2000

[54] ADJUSTABLE TOOL BIT STORAGE STRUCTURE FOR A TOOL BOX

[76] Inventor: hsiu chu Wen, 7F, No.8, Sec.3, Lane 95, Jin Maa Rd., Changhua, Taiwan

[21] Appl. No.: 09/428,288

[22] Filed: Oct. 27, 1999

[51] Int. Cl.[7] ..... B65D 85/28

[52] U.S. Cl. ..... 206/379; 206/372; 211/69; 211/70.6

[58] Field of Search ..... 206/379, 378, 206/373, 372, 443, 376, 493; 211/69, 70.6

[56] References Cited

U.S. PATENT DOCUMENTS 5,006,066 4/1991 Rouse ..... 206/379
5,535,882 7/1996 Liu ..... 206/377
5,570,784 11/1996 Sidabras et al. ..... 206/378

*Primary Examiner*—Paul T. Sewell
*Assistant Examiner*—Nhan T. Lam
*Attorney, Agent, or Firm*—Pro-Techtor International Services

[57] ABSTRACT

An adjustable tool bit storage structure provided in a tool box for keeping tool bits, which includes two upright lugs arranged in the tool box in parallel, a shaft pivoted to the two upright lugs and turned between a horizontal position and a vertical position, means for holding the shaft in one of a series of angular positions between the horizontal position and the vertical position, and a plurality of tool bit storage members respectively mounted on the shafts and secured in place by collars at the shaft for keeping tool bits.

4 Claims, 4 Drawing Sheets

ADJUSTABLE TOOL BIT STORAGE STRUCTURE FOR A TOOL BOX

BACKGROUND OF THE INVENTION

The present invention relates to a toolbox, and more specifically to an adjustable tool bit storage structure for a toolbox.

A variety of toolboxes have been disclosed, and have appeared on the market. These toolboxes commonly have different storage chambers and holder means for holding any of a variety of tools and tool bits. Because tool bits are small items, it is difficult to arrange tool bits in a toolbox, or to pick up tool bits from the storage chambers or holder means of the toolbox.

SUMMARY OF THE INVENTION

The present invention has been accomplished to provide an adjustable tool bit storage structure, which eliminates the aforesaid problems. According to the present invention, the adjustable tool bit storage structure is comprised of two upright lugs arranged in the tool box in parallel, a shaft pivoted to the two upright lugs and turned between a horizontal position and a vertical position, means for holding the shaft in one of a series of angular positions between the horizontal position and the vertical position, and a plurality of tool bit storage members respectively mounted on the shafts and secured in place by collars at the shaft for keeping tool bits. Because the shaft can be positioned in one of a series of angular positions between the horizontal position and the vertical position, the tool bit storage members can be turned with the shaft to a particular angle convenient for arrangement of storage tool bits.

DETAILED DESCRIPTION OF THE PREFERRED EMBODIMENT

Figure 1:
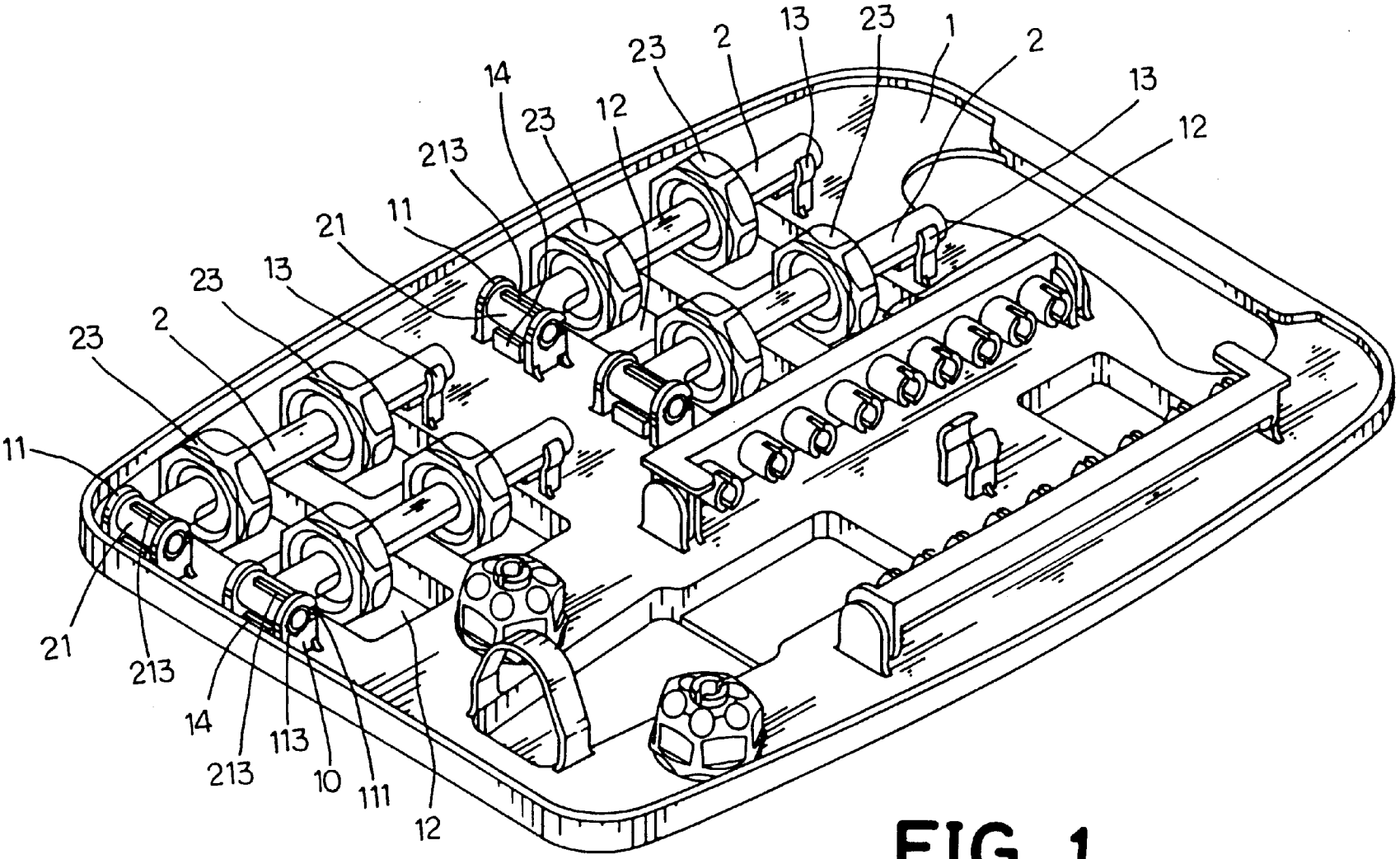
FIG. 1 is a perspective view of a toolbox according to the present invention.
Figure 2:
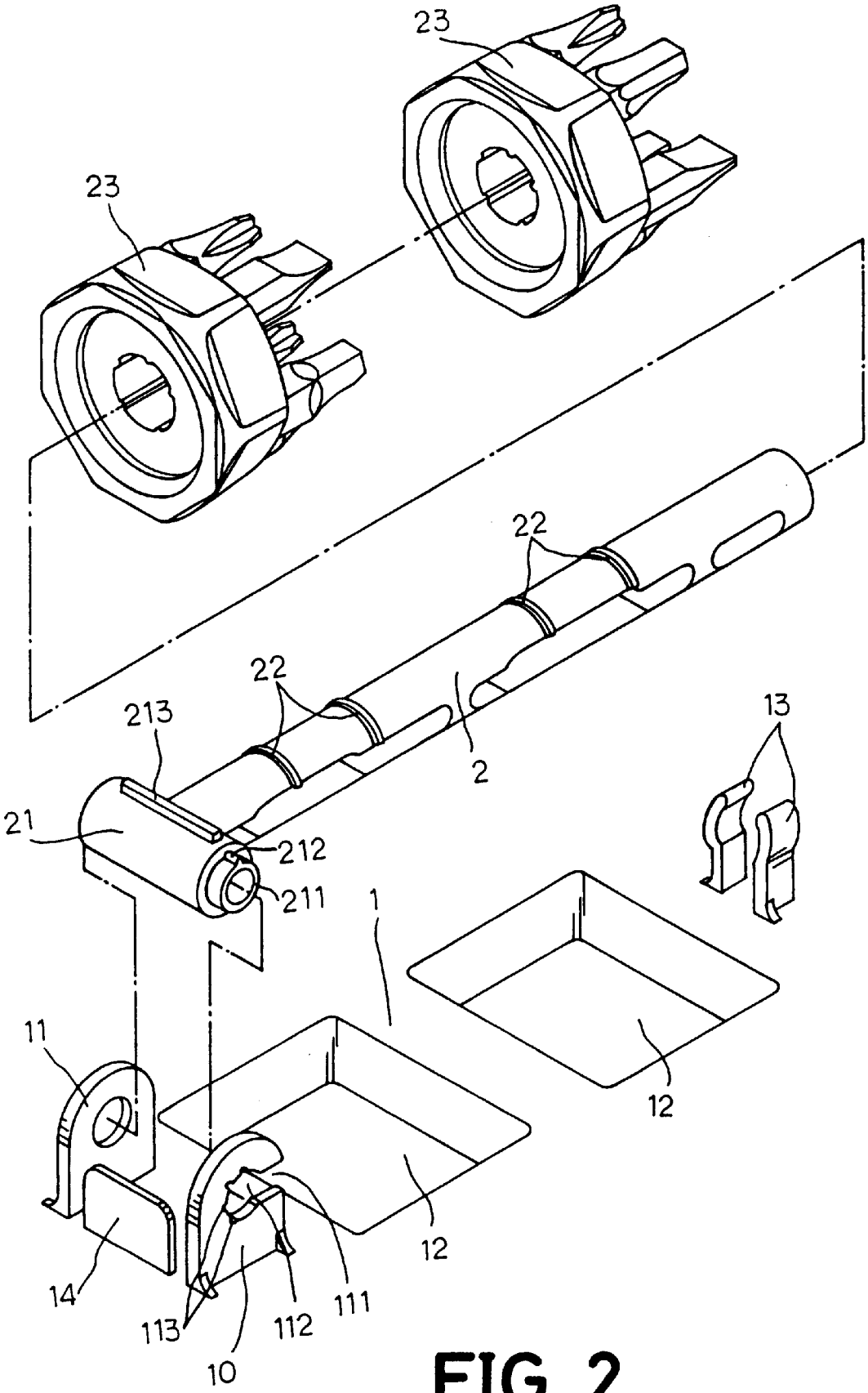
FIG. 2 is an exploded view in an enlarged scale of a part of FIG. 1, showing the arrangement of an adjustable tool bit storage structure.

Referring to FIGS. 1 and 2, a plurality of adjustable tool bit storage structures are provided in a tool box 1, each adjustable tool bit storage structure comprising a first upright lug 10 and a second upright lug 11 arranged in parallel, a shaft 2 pivoted to the upright lugs 10 and 11, and a plurality of tool bit storage members 23 mounted on the shaft 2 for holding a variety of tool bits.

The first upright lug 10 and the second upright lug 11 each have a center axle hole 112. The first upright lug 10 comprises a side opening 111 extended sideways from its center axle hole 112 to the border thereof, and a plurality of positioning notches 113 spaced around its center axle hole 112. The shaft 2 comprises a transverse head 21 at one end thereof, two coupling portions 211 respectively extended from two opposite ends of the transverse head 21 and coupled to the center axle hole 112 at each of the upright lugs 10 and 11 for enabling the shaft 2 to be turned about an axis passing through the center axle hole 112 at each of the upright lugs 10 and 11, and an axial rib 212 at one coupling portion 211 for engagement with one of the positioning notches 113 at the first upright eyed lug 10 to hold the shaft 2 in one of a series of angular positions. The tool bit storage members 23 are mounted on the shaft 2 and secured in place by collars 22 at the shaft 2, each defining a plurality of storage chambers (not shown) for holding tool bits.

Figure 3:
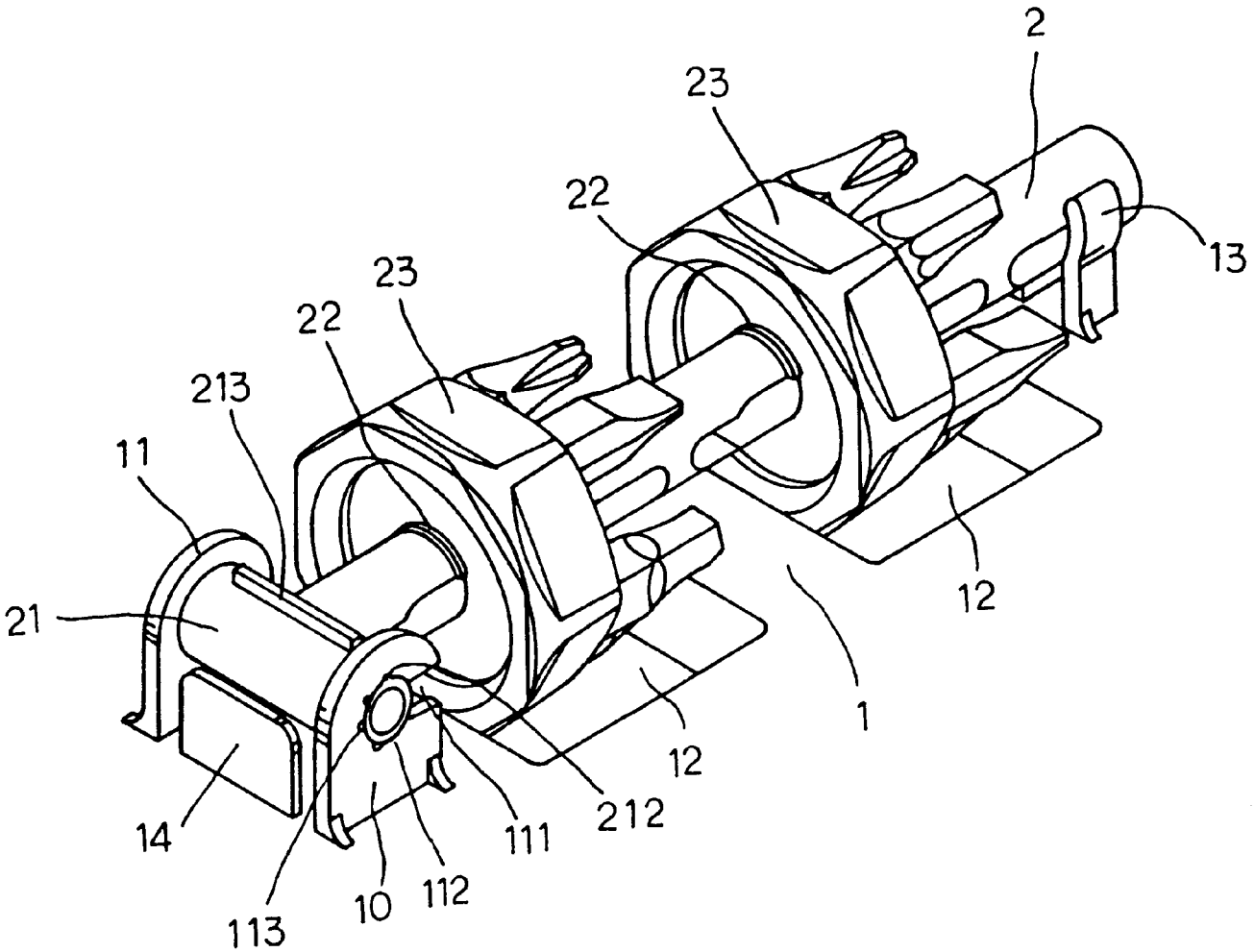
FIG. 3 is a perspective assembly view of FIG. 2.
Figure 4:
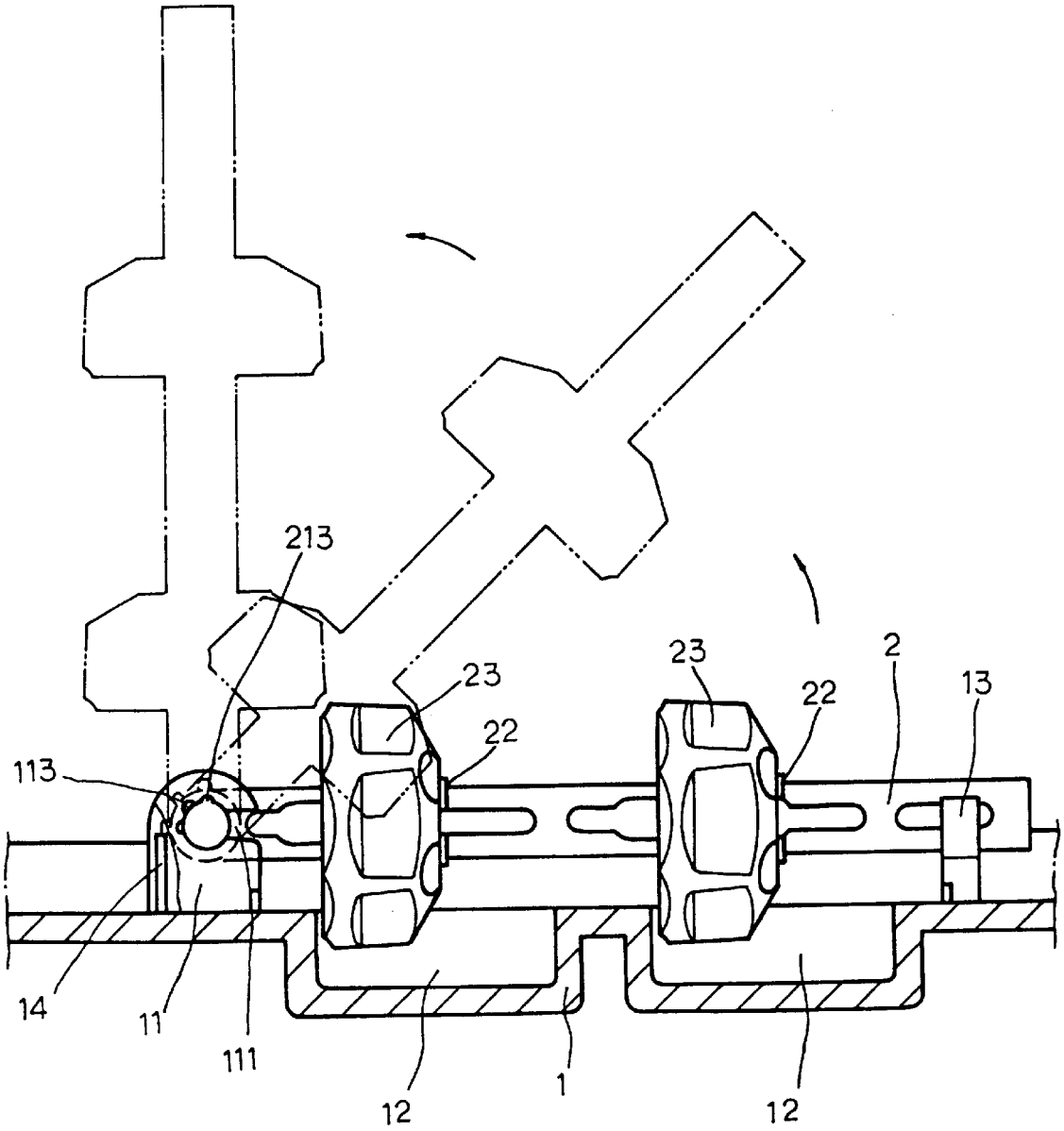
FIG. 4 is a sectional view showing the adjustment of the adjustable tool bit storage structure according to the present invention.

Referring to FIGS. 3 and 4 and FIGS. 1 and 2 again, two upright clamping plates 13 are provided inside the tool box 1 for receiving the free end (the end remote from the transverse head 21) of the shaft 2 to hold the shaft 2 in a horizontal position. A plurality of recessed holes 12 are provided in the tool box 1 between the upright lugs 10 and 11 and the upright clamping plates 13 for receiving the tool bit storage members 23 when the shaft 2 is turned downwards to the horizontal position (see FIG. 3). An upright stop plate 14 is provided inside the tool box 1 between the upright lugs 10 and 11 for supporting the shaft 2 in a vertical position. The shaft 2 comprises a stop flange 213 provided at the transverse head 21. When the shaft 2 is turned upwards from the horizontal position to the vertical position, the stop flange 213 is stopped at the upright stop plate 14, and therefore the shaft 2 is supported in the vertical position.

While only one embodiment of the present invention has been shown and described, it will be understood that various modifications and changes could be made thereunto without departing from the spirit and scope of the invention disclosed.

What the invention claimed is:

1. An adjustable tool bit storage structure provided in a toolbox for keeping tool bits, comprising:

a first upright lug and a second upright lug arranged in parallel, said first upright lug and said second upright lug each comprising a center axle hole, said first upright lug comprising a side opening extended sideways from the center axle hole thereof to the border thereof, and a plurality of positioning notches spaced around the center axle hole thereof;

a shaft having a fixed end pivoted to said first upright lug and said second upright lug and a free end, said shaft comprising a transverse head provided at one end thereof and pivoted to said first upright lug and said second upright lug, two coupling portions respectively extended from two opposite ends of said transverse head and coupled to the center axle hole at each of said first upright lug and said second upright lug for enabling said shaft to be turned about an axis passing through the center axle hole at each of said first upright lug and said second upright lug between a horizontal position and a vertical position, an axial rib at one of said coupling portions for engagement with one of the positioning notches at said first upright eyed lug to hold said shaft in one of a series of angular positions between said horizontal position and said vertical position, and a plurality of axially spaced collars;

a plurality of tool bit storage members respectively mounted on said shafts and secured in place by said collars for holding tool bits; and positioning means for holding said shaft in said vertical position.

2. The adjustable tool bit storage structure of claim 1 further comprising clamping means provided in the tool box for the free end of said shaft to hold said shaft in said horizontal position.

3. The adjustable tool bit storage structure of claim 2 further comprising a plurality of recessed holes provided in the tool box and spaced between said first and second upright lugs and said clamping means for receiving said tool bit storage members when said shaft is turned to said horizontal position.

4. The adjustable tool bit storage structure of claim 1 wherein said positioning means comprises an upright stop plate provided in the tool box between said first upright lug and said second upright lug, and a stop flange provided at the transverse head of said shaft which is stopped at said upright stop plate when said shaft is turned to said vertical position.

* * * * *